US008820497B1

(12) United States Patent
Goldsmith et al.

(10) Patent No.: US 8,820,497 B1
(45) Date of Patent: Sep. 2, 2014

(54) SPORTS BAG WITH CHAIR DEVICE

(76) Inventors: Mike J. Goldsmith, Hamilton (CA); Luke Watson, Hamilton (CA)

( * ) Notice: Subject to any disclaimer, the term of this patent is extended or adjusted under 35 U.S.C. 154(b) by 167 days.

(21) Appl. No.: 13/543,703

(22) Filed: Jul. 6, 2012

Related U.S. Application Data

(60) Provisional application No. 61/504,396, filed on Jul. 5, 2011.

(51) Int. Cl.
*A45C 5/14* (2006.01)

(52) U.S. Cl.
USPC ..... 190/8; 190/18 A; 190/315.1

(58) Field of Classification Search
USPC ..... 190/1, 8, 18 A; 206/315.1
See application file for complete search history.

(56) References Cited

U.S. PATENT DOCUMENTS 5,533,654 A 7/1996 Holty et al.
5,695,246 A * 12/1997 Tsai ..... 297/335
5,957,349 A 9/1999 Krulik
6,315,115 B1 * 11/2001 Bradshaw et al. ..... 206/315.4
6,557,702 B1 * 5/2003 Sanderson et al. ..... 206/315.4
6,926,129 B2 * 8/2005 Hoberman ..... 190/107
7,077,252 B2 * 7/2006 Sanchez ..... 190/108
7,316,407 B1 1/2008 Elden
7,350,857 B2 4/2008 Bishop
7,419,037 B2 * 9/2008 Nordstrom ..... 190/107
7,424,950 B2 * 9/2008 Burgess et al. ..... 206/315.3
7,644,810 B2 * 1/2010 Duncan ..... 190/8
7,717,263 B2 * 5/2010 Evans et al. ..... 206/315.7
2003/0029751 A1 * 2/2003 Boardman et al. ..... 206/315.4
2012/0325607 A1 * 12/2012 Webster et al. ..... 190/115

* cited by examiner

*Primary Examiner* — Tri Mai
(74) *Attorney, Agent, or Firm* — Crossley Patent Law; Micah C. Gunn

(57) ABSTRACT

The sports bag with chair device provides a rigid front connected to a pliable rear, a top spaced apart from a bottom, and a pair of spaced apart sides, a top handle disposed within the top pliable rear, a pair of spaced apart wheels disposed on the rigid front bottom, the wheels extended forwardly from the front, an upper compartment disposed within the pliable rear top, a lower compartment disposed rearwardly and downwardly within the pliable rear, a closure selectively closing each compartment, a recess disposed about midway within the rigid front, a pivoted chair disposed within the recess, the pivoted chair selectively positioned within and without the recess, and a pair of spaced apart telescopic legs pivotally affixed forwardly and downwardly on the pivoted chair.

2 Claims, 5 Drawing Sheets

SPORTS BAG WITH CHAIR DEVICE

CROSS-REFERENCE TO RELATED APPLICATIONS

U.S. Provisional Application No. 61504396 filed on Jul. 5, 2011

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Sports bags have become quite popular, and a bag particularly best suited to baseball has been needed. What has been needed is a rollable sports bag that can stand on its own and that incorporates a chair than can pivotally retreat, and compartmentalized storage within the bag also that is especially suited to baseball use. The present device uniquely provides these and other features.

FIELD OF THE INVENTION

The sports bag with chair device relates to sports bags and more especially to a bag that stands on its own, has room for baseball bats, and also has an integral, pivoting chair.

SUMMARY OF THE INVENTION

The general purpose of the sports bag with chair device, described subsequently in greater detail, is to provide a sports bag with chair device which has many novel features that result in an improved sports bag with chair device which is not anticipated, rendered obvious, suggested, or even implied by prior art, either alone or in combination thereof.

To attain this, the sports bag with chair device provides a bag that selectively provides an outwardly pivoting chair. The device also stands on its own. The chair selectively pivots from the device front, which is rigid for self support and for chair support. The remaining interior of the device has separate compartments for use as a sports bag and a bag device that is especially suited to baseball.

The downward position of the pivoting chair may also provide for the chair to have an extension angle of about 100-110 degrees downwardly from the rigid front. With the greater pivot angle provided, pivoted rear supports may also be provided. In this way, a user may enjoy a slightly reclined seating position on the chair while being assured of no backward tip.

Compartments may employ various appropriate form of closure that include but are not limited to hook and loop, snaps, zippers, buttons, hooks, and any number of other appropriate closures. The top of the pliable rear has a taper, to aid in device upright stance stability due to center of gravity. The sides each have an upwardly tapered rigid side panel to support the pivoted rear supports and also to support the mass of objects selectively contained in the compartments. The spaced apart wheels may importantly be positioned forwardly from the rigid front bottom for best stability in wheeled transport of the device. Failure to position the wheels so may otherwise result in side-to-side wobble so often noted in travel baggage and the like.

Thus has been broadly outlined the more important features of the improved sports bag with chair device so that the detailed description thereof that follows may be better understood and in order that the present contribution to the art may be better appreciated.

An object of the sports bag with chair device is to provide a sports bag.

Another object of the sports bag with chair device is to provide a bag with divided storage compartments.

A further object of the sports bag with chair device is to provide a wheeled bag.

An added object of the sports bag with chair device is to provide a chair affixed to the bag.

And, an object of the sports bag with chair device is to provide a chair that can selectively pivot outwardly from the bag.

Still another object of the sports bag with chair device is to provide for reclined seating.

And, an object of the sports bag with chair device is to provide a chair that does not position a user atop the device.

Still a further object of the sports bag with chair device is to provide for the device to stand on its own.

These together with additional objects, features and advantages of the improved sports bag with chair device will be readily apparent to those of ordinary skill in the art upon reading the following detailed description of presently preferred, but nonetheless illustrative, embodiments of the improved sports bag with chair device when taken in conjunction with the accompanying drawings.

DETAILED DESCRIPTION OF THE DRAWINGS

Figure 1:
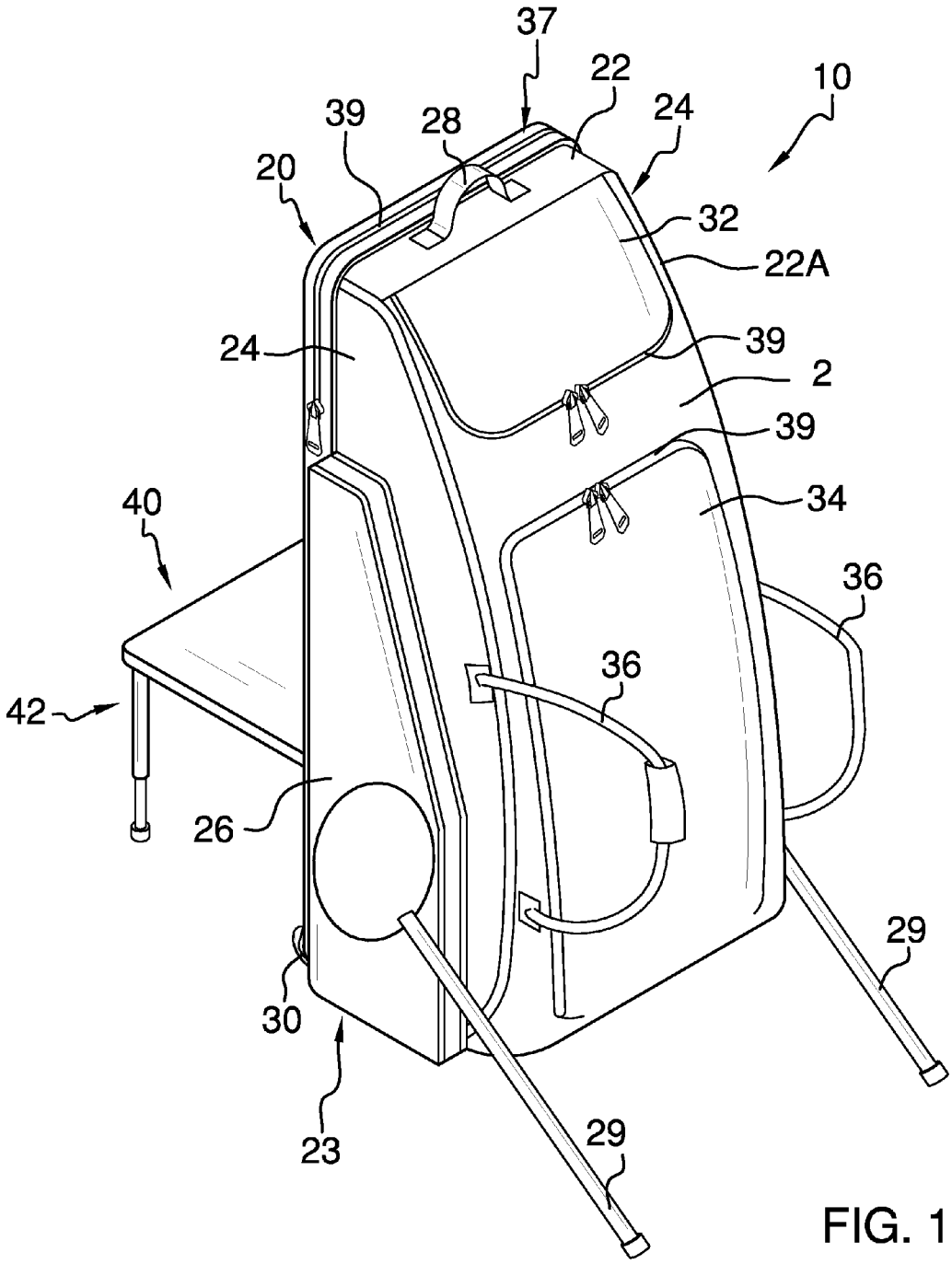
FIG. 1 is a perspective rear view, a chair pivoted outwardly.
Figure 2:
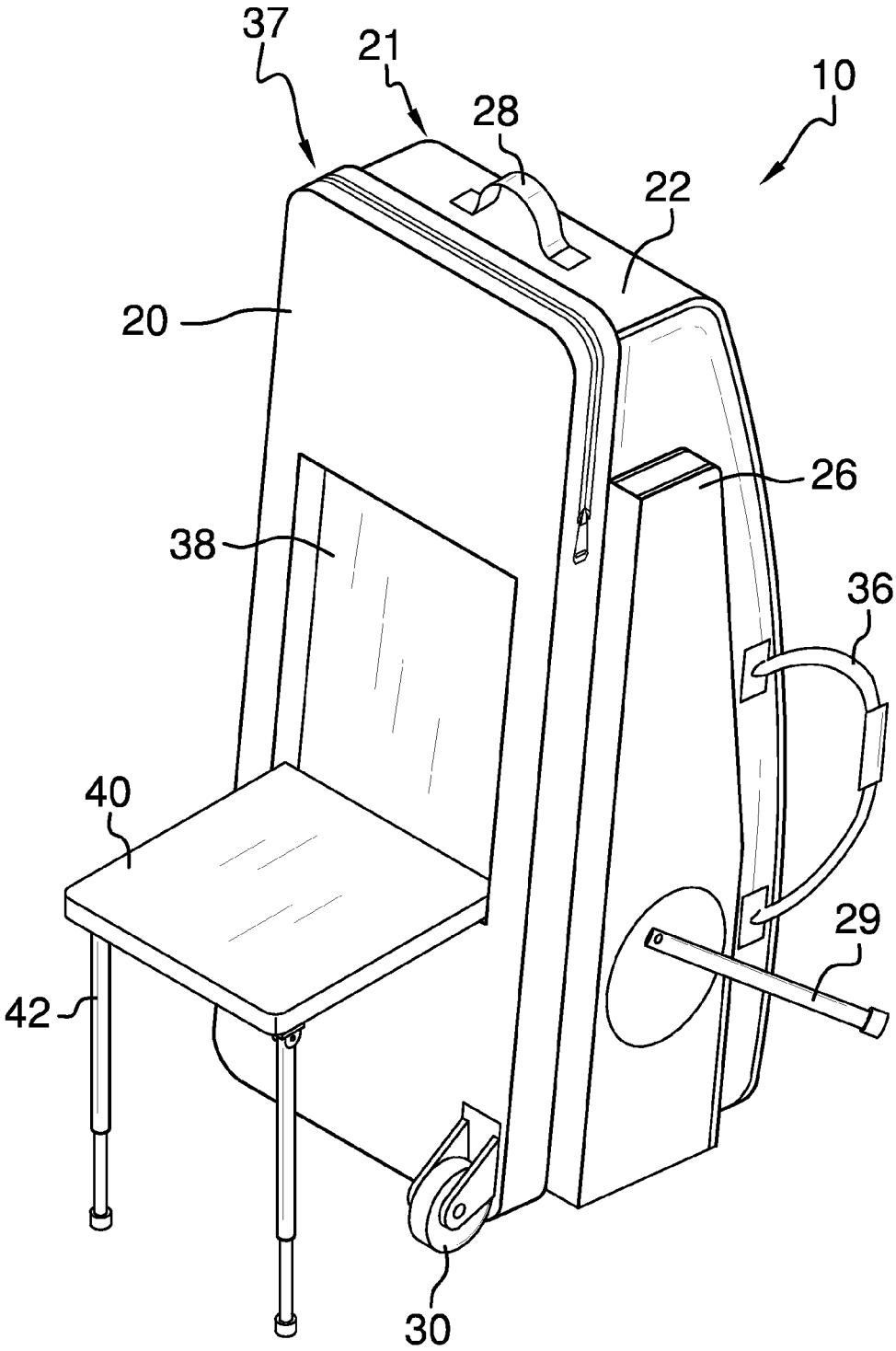
FIG. 2 is a perspective front view, the chair pivoted outwardly.
Figure 3:
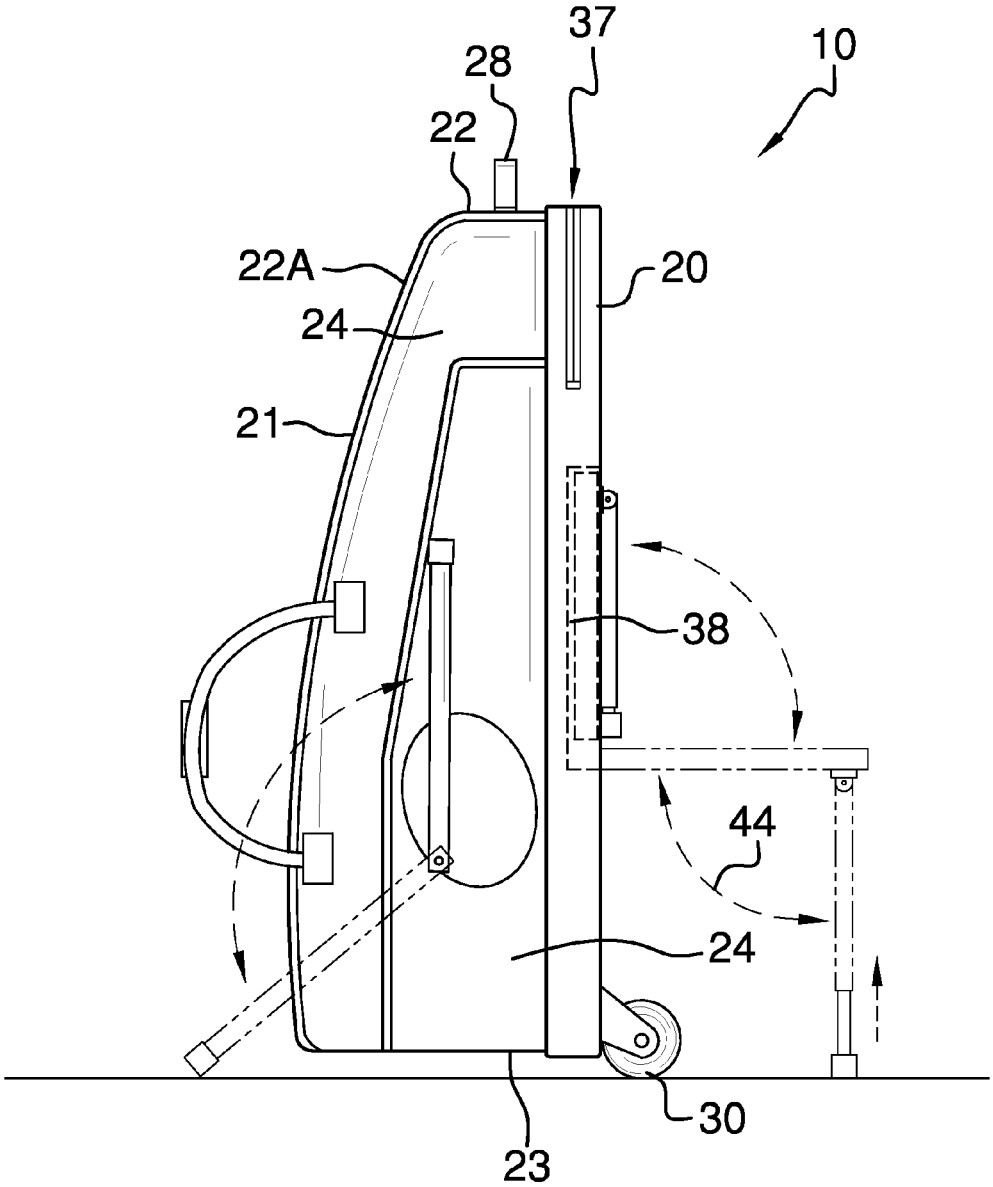
FIG. 3 is a side elevation view.
Figure 4:
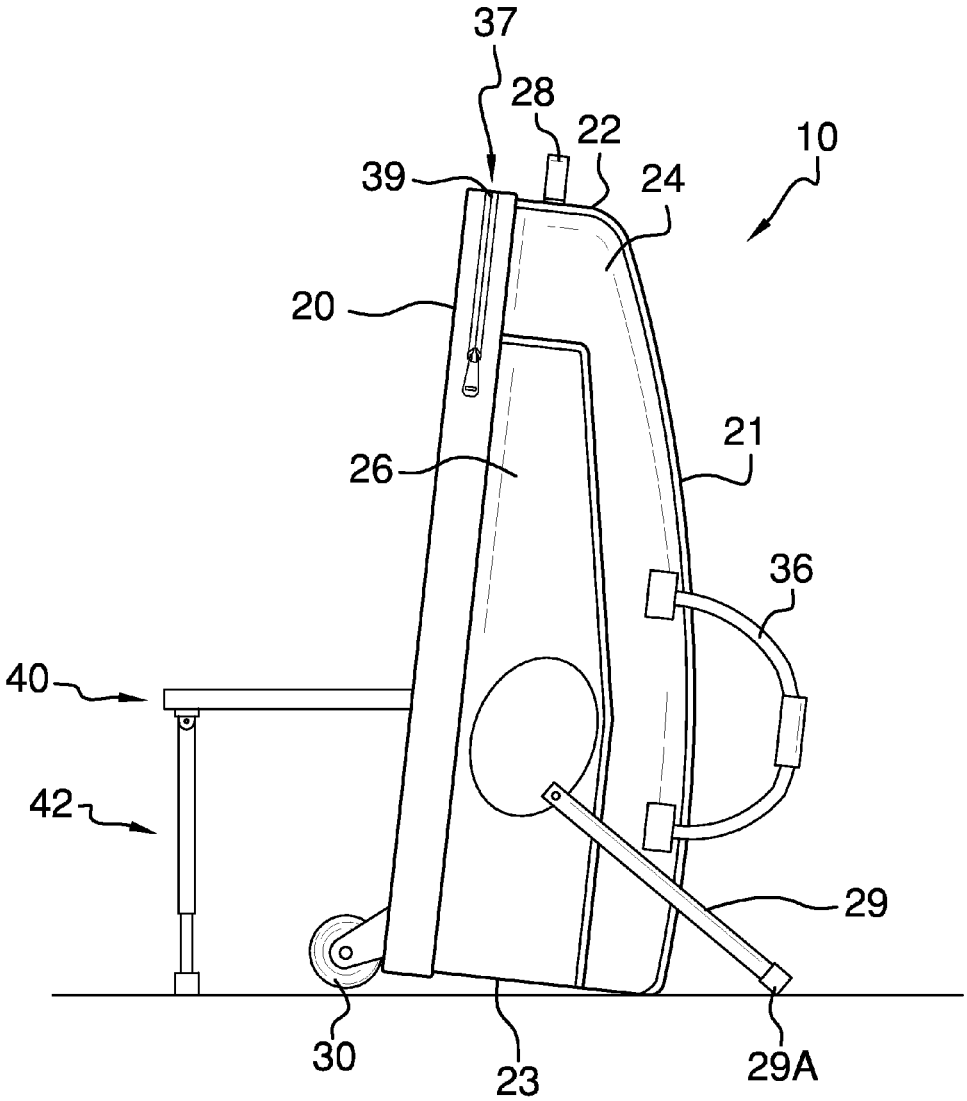
FIG. 4 is a right side elevation view, the chair pivoted outwardly and employing the 100+ degrees of pivot angle.
Figure 5:
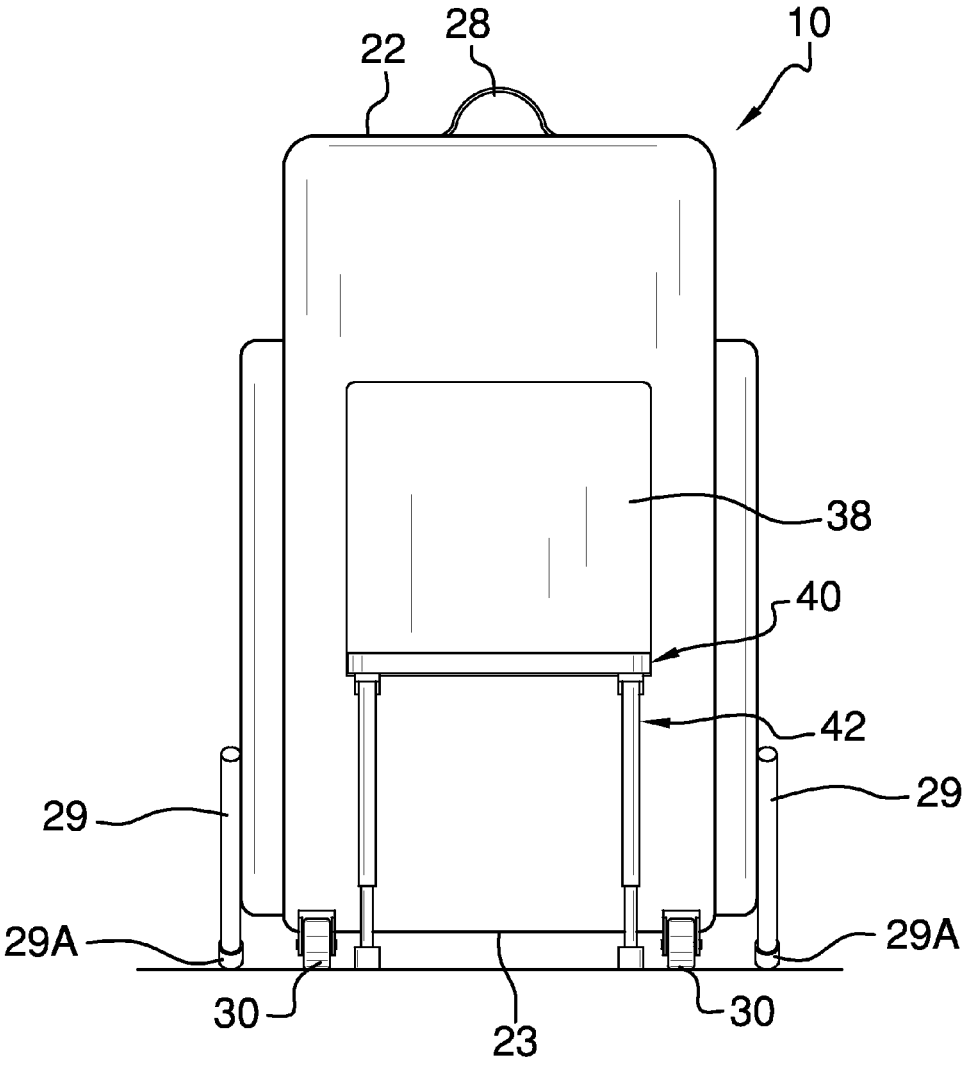
FIG. 5 is a front elevation view.

With reference now to the drawings, and in particular FIGS. 1 through 5 thereof, the principles and concepts of the sports bag with chair device generally designated by the reference number 10 will be described.

The device 10 partially comprises a rigid front 20. The device 10 further comprises a pliable rear 21 connected to the rigid front 20, a top 22 spaced apart from a bottom 23, and a pair of spaced apart sides 24. The device further comprises a taper 22A is disposed upwardly on the pliable rear 1.

An upwardly tapered rigid side panel 26 is disposed on each side 24. The upwardly tapered rigid side panels 26 extend upwardly from the bottom 23 to proximal to the top 22.

A pivoted rear support 29 is affixed to each upwardly tapered rigid side panel 26. A frictional tip 29A is disposed distally on each pivoted rear support 29.

A top handle 28 is disposed on the pliable rear 21 top 22. A pair of spaced apart wheels 30 is disposed forwardly on the rigid front 20 bottom 23.

An upper compartment 32 is disposed upwardly within the pliable rear 21. A lower compartment 34 is disposed rearwardly and downwardly within the pliable rear 21. A top compartment 37 is disposed within the rigid front 20 top 22. A closure 39 selectively closes each compartment.

A side handle 36 is disposed on each side 24 of the pliable rear 21. The side handles 36 are attached above and below a midpoint of the lower compartment 34.

A recess 38 is disposed about midway within the rigid front 20. A pivoted chair 40 is disposed within the recess 38. The pivoted chair 40 is selectively positioned within and without the recess 38 and is pivoted upwardly when installed in the recess 38. The pivoted chair 40 is configured to pivot outwardly to a pivot angle 44 of about 100-110 degrees relative to the front 20.

A pair of spaced apart telescopic legs 42 is pivotally affixed distally and downwardly on the pivoted chair 40 so that the pivoted chair 40 is supported in the downward position.

When the chair 40 is in a horizontal position, the front 20 has the top 22 tilted backward. The chair 40 in-use position pivoted and down has the pivoted rear supports 29 pivoted down so the frictional tips 29A contact the surface upon which the sports bag 10 rests to prevent tipping of the sports bag 10 when the chair 40 is in use.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the sports bag with chair device may be used.

What is claimed is:

1. A sports bag with chair device comprising:

a rigid front spaced connected to a pliable rear, a top spaced apart from a bottom, and a pair of spaced apart sides;

a taper disposed upwardly on the pliable rear;

an upwardly tapered rigid side panel disposed on each side, the upwardly tapered rigid side panels extended upwardly from the bottom to proximal to the top;

a pivoted rear support affixed to each upwardly tapered rigid side panel;

a frictional tip disposed distally on each pivoted rear support;

a plurality of spaced apart wheels disposed on the bottom, the wheels extended forwardly from the front;

an upper compartment disposed upwardly within the pliable rear top;

a lower compartment disposed rearwardly and downwardly within the pliable rear;

a top compartment disposed within the rigid front top;

a closure selectively closing each compartment;

a side handle disposed on each side of the pliable rear, the side handles aligned at about a midpoint of the lower compartment;

a recess disposed about midway within the rigid front;

a pivoted chair disposed within the recess, the pivoted chair selectively positioned within and without the recess;

a pair of spaced apart telescopic legs pivotally affixed distally and downwardly on the pivoted chair;

a pair of spaced apart wheels disposed forwardly from the rigid front bottom.

2. A sports bag with chair device comprising, in combination:

a rigid front spaced connected to a pliable rear, a top spaced apart from a bottom, and a pair of spaced apart sides;

a taper disposed upwardly on the pliable rear;

an upwardly tapered rigid side panel disposed on each side, the upwardly tapered rigid side panels extended upwardly from the bottom to proximal to the top;

a pivoted rear support affixed to each upwardly tapered rigid side panel;

a frictional tip disposed distally on each pivoted rear support;

a pair of spaced apart wheels disposed on the bottom, the wheels extended forwardly from the front;

an upper compartment disposed upwardly within the pliable rear top;

a lower compartment disposed rearwardly and downwardly within the pliable rear;

a top compartment disposed within the rigid front top;

a closure selectively closing each compartment;

a side handle disposed on each side of the pliable rear, the side handles aligned at about a midpoint of the lower compartment;

a recess disposed about midway within the rigid front;

a pivoted chair disposed within the recess, the pivoted chair selectively positioned within and without the recess, the pivoted chair selectively positioned within and without the recess, the chair configured to pivot outwardly to a pivot angle of about 100-110 degrees relative to the front;

a pair of spaced apart telescopic legs pivotally affixed distally and downwardly on the pivoted chair.

* * * * *